US008544845B2

(12) United States Patent
Okamoto

(10) Patent No.: US 8,544,845 B2
(45) Date of Patent: Oct. 1, 2013

(54) DEVICE FOR CONTAINING AND DISCHARGING PAPER SHEETS OR THE LIKE

(75) Inventor: Masaaki Okamoto, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 46 days.

(21) Appl. No.: 12/737,127

(22) PCT Filed: May 19, 2009

(86) PCT No.: PCT/JP2009/059200

§ 371 (c)(1),
(2), (4) Date: Dec. 10, 2010

(87) PCT Pub. No.: WO2009/150924

PCT Pub. Date: Dec. 17, 2009

(65) Prior Publication Data

US 2011/0084444 A1 Apr. 14, 2011

(30) Foreign Application Priority Data

Jun. 11, 2008 (JP) ..... 2008-153268

(51) Int. Cl.
*B65H 5/02* (2006.01)

(52) U.S. Cl.
USPC ..... 271/275; 242/528

(58) Field of Classification Search
USPC ..... 271/3.14, 3.21, 3.01, 275; 242/528
See application file for complete search history.

(56) References Cited

U.S. PATENT DOCUMENTS

| | | | | |
|---|---|---|---|---|
| 4,871,125 | A | 10/1989 | Haueter | |
| 6,431,778 | B1 * | 8/2002 | Coudray et al. | 400/635 |
| 6,565,082 | B2 * | 5/2003 | Sasaki et al. | 271/216 |
| 6,568,673 | B2 * | 5/2003 | Mochizuki et al. | 271/213 |
| 7,014,188 | B2 * | 3/2006 | Polidoro et al. | 271/216 |

FOREIGN PATENT DOCUMENTS

| | | | |
|---|---|---|---|
| JP | 63-295349 | A | 12/1988 |
| JP | 08-067382 | A | 3/1996 |
| JP | 8-217300 | A | 8/1996 |
| JP | 2000-118812 | A | 4/2000 |

* cited by examiner

*Primary Examiner* — Michael McCullough
(74) *Attorney, Agent, or Firm* — Rabin & Berdo, P.C.

(57) ABSTRACT

Provided is a unit for preventing abnormal conveyance when unreeling a banknote from a drum. A device for storing and discharging paper/paper-like sheets is provided with first and second reels for winding first and second tapes onto, a drum for winding the first and second tapes onto with a banknote sandwiched between respective conveying surfaces of the first and second tapes, and first and second deflecting rollers disposed facing a banknote inlet-outlet and respectively deflecting the first and second tapes toward the drum. The device takes up, or unwinds, the first and second tapes entrained between the drum and the first and second reels via the first and second deflecting rollers so as to store or discharge the banknote. The device is also provided with a guide having a projection projecting toward the drum. The guide is mounted at the first deflecting roller side between the first deflecting roller and the drum, so as to be located on the rear surface side of the first tape running from the first deflecting roller to the drum.

5 Claims, 4 Drawing Sheets

DEVICE FOR CONTAINING AND DISCHARGING PAPER SHEETS OR THE LIKE

TECHNICAL FIELD

The present invention relates to a device for storing and discharging paper/paper-like sheets, the device stores paper/paper-like sheets, such as banknotes, checks, deeds and the like, taken up together with a tape onto a drum, and unwinds the tape to discharge the stored paper/paper-like sheets.

BACKGROUND ART

As a conventional device for storing and discharging paper/paper-like sheets, a banknote storing and discharge device exists, configured with a first reel on which a first tape is taken up, a second reel on which a second tape is taken up, a drum on which the first tape and the second tape meet and are taken up, first and second deflecting rollers that deflect the first and second tapes towards the drum, respectively. A banknote that has been received in between the first and second tapes entrained around the first and second deflecting rollers, respectively, is taken up and stored with central portions of the banknote sandwiched between respective conveying surfaces. The first and second tapes are unwound, and the banknote that has been taken up onto the drum is unreeled while still sandwiched between the respective conveying surfaces of the first and second tapes and conveyed towards a banknote inlet-outlet and discharged (see, for example, Japanese Patent Application Laid-Open (JP-A) No. 8-67382, mainly at paragraph 0008 to 0012, FIG. 1 and FIG. 2).

SUMMARY OF INVENTION

Technical Problem

In the above described conventional technology, the banknote that has been taken up onto the drum is unreeled while still sandwiched between the respective conveying surfaces of the first and second tapes, and conveyed towards a banknote inlet-outlet. Consequently, when the banknote is unreeled from the drum, a corner portion at the unreeling direction leading end side of the banknote released from restraint by the drum and the tapes, as shown in FIG. 8, folds over towards the tape side due to a tendency of the banknote to fold and curl, and sometimes such a corner folded portion DE folds over the rear surface of the tape on the opposite side of the tape to the conveying surface. In such cases, the corner folded portion DE becomes sandwiched between the deflecting roller and the tape rear surface, possibly leading to abnormal feed occurring, such as the banknote being conveyed in the unreeling direction jamming or becoming skewed, ripped or the like.

The present invention is directed towards solving the above points, and provides a unit to prevent abnormal conveyance when unreeling paper/paper-like sheets, such as banknotes, from a drum.

Solution to Problem

A first aspect of the present invention is a paper and paper-like sheet storage and discharge device including: a reel on which a tape is taken up; a drum for taking up the tape together with a paper/paper-like sheet; a deflection roller disposed between the reel and the drum and deflecting the tape towards the drum; and a guide having a projection that projects out towards the drum, the guide disposed at the deflection roller side between the deflection roller above the tape reaching from the deflection roller to the drum, wherein the tape entrained between the reel and the drum via the deflection roller is taken up or unwound, storing or discharging the paper/paper-like sheet.

Advantageous Effects of Invention

Accordingly, in the present invention, when unreeling a paper/paper-like sheet from the drum, a corner folded portion attempting to fold over to cover over the tape is made to contact the side faces of the projection along the conveying direction, and the fold can be straitened before the corner folded portion covers over the tape. Consequently, abnormal conveyance can be prevented of the paper/paper-like sheet being conveyed in the unreeling direction.

DESCRIPTION OF EMBODIMENTS

Explanation follows regarding exemplary embodiments of a paper and paper-like sheet storage and discharge device according to the present exemplary embodiment, with reference to the drawings.

First Exemplary Embodiment

Figure 1:
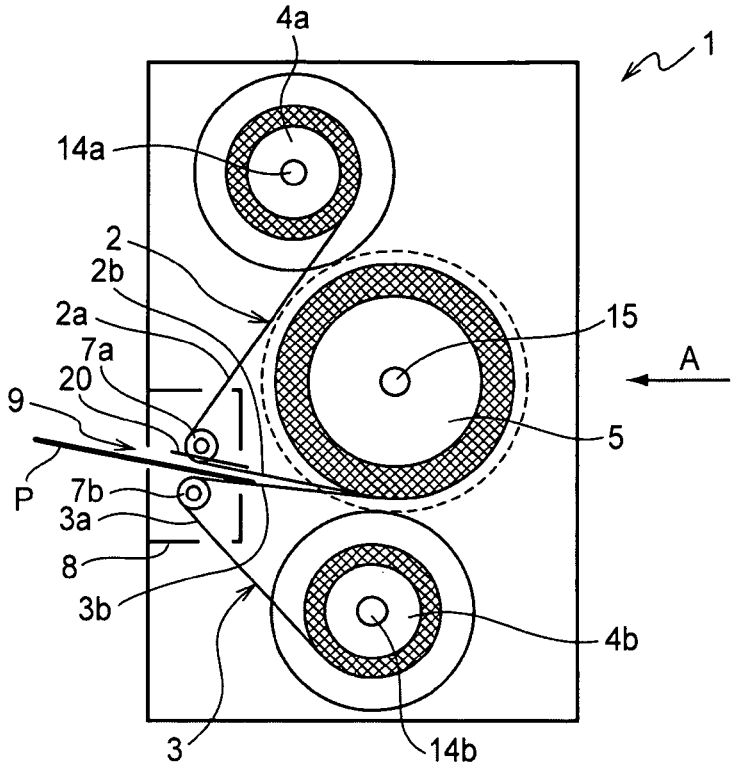
FIG. 1 is an explanatory diagram showing a side face of a banknote storage and discharge device of a first exemplary embodiment.
Figure 2:
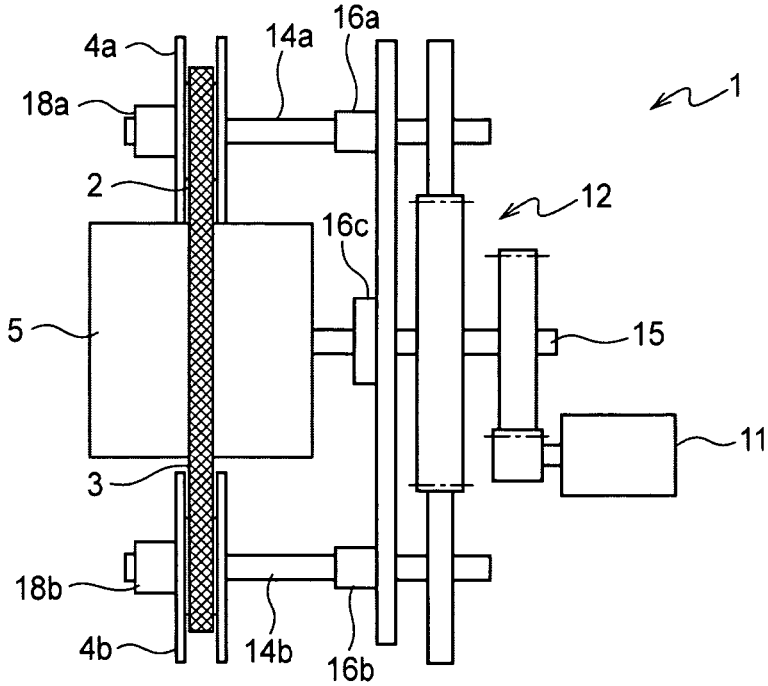
FIG. 2 is a back view as seen along the direction of arrow A in FIG. 1.
Figure 3:
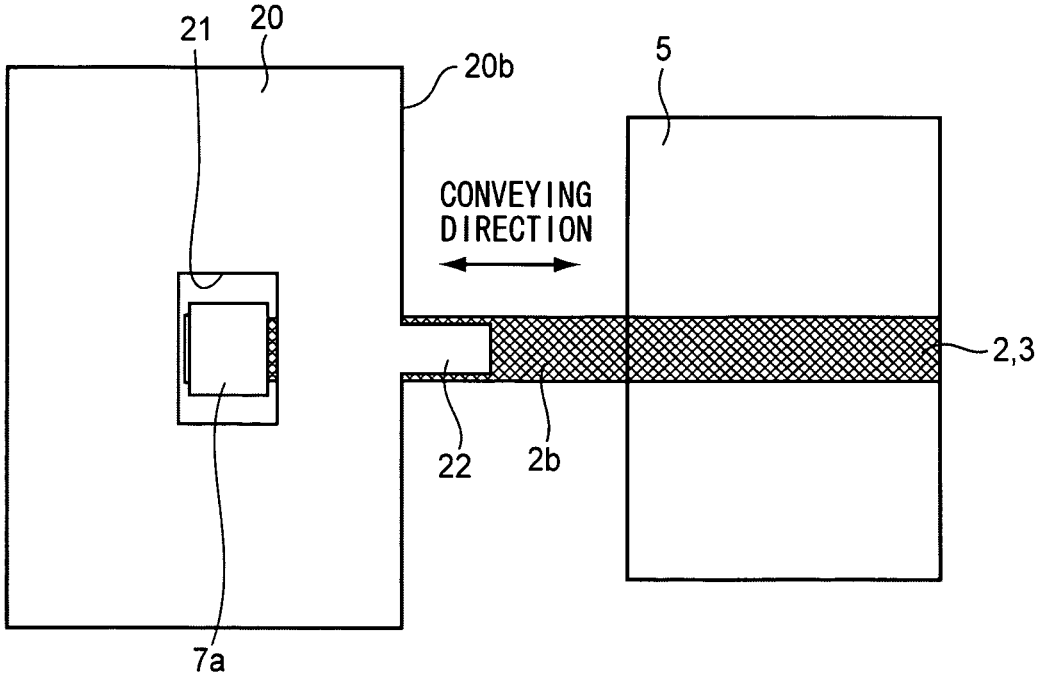
FIG. 3 is an explanatory diagram showing the top face of a guide plate of the first exemplary embodiment.
Figure 4:
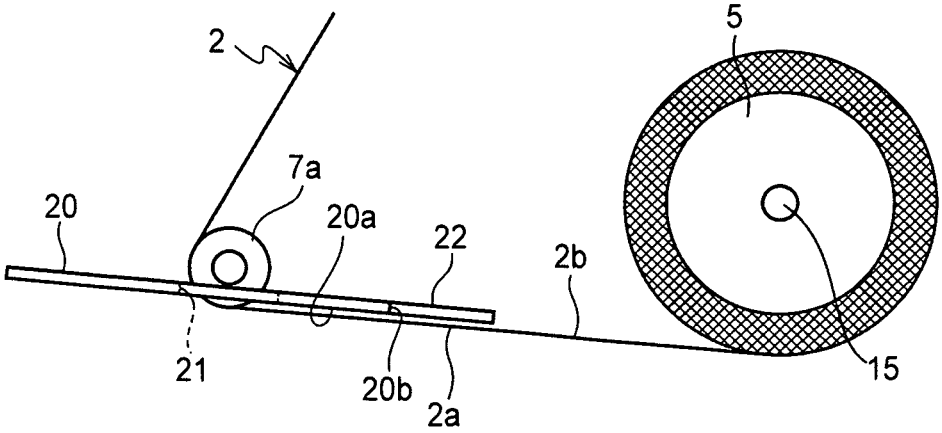
FIG. 4 is an explanatory diagram showing a side face of a guide plate of the first exemplary embodiment.

FIG. 1 is an explanatory diagram showing a side face of a banknote storage and discharge device of a first exemplary embodiment, FIG. 2 is a view as seen along the direction of arrow A in FIG. 1, FIG. 3 is an explanatory diagram showing the top face of a guide plate of the first exemplary embodiment, and FIG. 4 is an explanatory diagram showing a side face of a guide plate of the first exemplary embodiment.

In FIG. 1, a banknote storage and discharge device 1, serving as a paper and paper-like sheet storage and discharge device, is employed as a temporary holding section of an automated transaction device, such as an Automated Teller Machine, an automatic ticketing machine, or the like.

A first tape 2 and a second tape 3 are formed in the same shape and the same length from the same material (for example, synthetic rubber) and one end of each is fixed to a first reel 4*a* and a second reel 4*b*, respectively, and the first tape 2 and the second tape 3 are taken up thereon.

Note that the first and second tapes 2, 3 are shown, respectively, annotated with a mesh pattern in each of the drawings.

Each of the other respective ends of the first tape 2 and the second tape 3 is fixed to a drum 5, and the first tape 2 and the second tape 3 are taken up on the drum 5 with a conveying surface 2*a* of the first tape 2 and a conveying surface 3*a* of the second tape 3 in state of contact.

First and second deflecting rollers 7*a*, 7*b* are rollers that freewheel about their rotation axes, are disposed facing a banknote inlet-outlet 9, serving as a paper or paper-like sheet inlet-outlet, formed in a banknote inlet-outlet section 8, serving as paper or paper-like sheet inlet-outlet section, in a state separated from the banknote inlet-outlet 9 by an amount such that a banknote P, serving as a paper or paper-like sheet, is insertable. Tape rear surfaces 2*b*, 3*b*, these being on the opposite faces of the first and second tapes 2, 3 to the conveying surfaces 2*a*, 3*a*, are entrained around the outer peripheral face of the first and second deflecting rollers 7*a*, 7*b*, respectively, deflecting the first and second tapes 2, 3 towards the drum 5.

The banknote P of the present exemplary embodiment is conveyed with its length direction along the conveying direction, and the banknote P is taken up onto the drum 5 while central portions in the short direction of the banknote P are sandwiched between the conveying surfaces 2*a*, 3*a* of the first and second tapes 2, 3.

Note that the intermittent line in FIG. 1 indicates the maximum external diameter of the first and second tapes 2, 3 when taken up with the banknote P sandwiched therebetween.

Detailed explanation follows regarding a guide plate 20, serving as a guide. In FIG. 2, a drive device 11, such a motor or the like, rotationally drives reel shafts 14*a*, 14*b* for rotating the first and second reels 4*a*, 4*b* and a drum shaft 15 for rotating the drum 5 in a forward or reverse direction using a gear train 12 of meshed large cog wheels and small cog wheels.

Clutches 16*a*, 16*b*, 16*c*, such as electromagnetic clutches or the like, have the function of interrupting driving force that is transmitted to the reel shafts 14*a*, 14*b* and the drum shaft 15 through the gear train 12 from transmission to the first and second reels 4*a*, 4*b* and the drum 5.

Torque limiters 18*a*, 18*b* limit torque and freewheel when load on the first and second reels 4*a*, 4*b* exceeds a set torque limit, and have the function of applying a specific tension to the first and second tapes 2, 3.

The guide plate 20 of the present exemplary embodiment, as shown in FIG. 1, is disposed at the first deflecting roller 7*a* side between the first deflecting roller 7*a* and the drum 5, and is disposed at the tape rear surface 2*b* side of the first tape 2 running from the first deflecting roller 7*a* towards the drum 5. A window portion 21, as shown in FIG. 3 and FIG. 4, is pierced through the guide plate 20 in the plate thickness direction from an opposing face 20*a* that faces the tape rear surface 2*b*. The first deflecting roller 7*a*, and the first tape 2 running across between the first reel 4*a* and the first deflecting roller 7*a*, are inserted though the window portion 21, and a projection 22 is formed to the guide plate 20 so as to project out towards the drum 5 from a central portion of a face 20*b* on the drum 5 side of the guide plate 20.

The guide plate 20 of the present exemplary embodiment, as shown in FIG. 4, is formed by a metallic material, such as a metal alloy or the like, or a resin material, and is a thin plate (thickness about 1 mm) having a width that is wider than the length of the conveyed banknote P in a direction orthogonal to the conveying direction (the short direction of the banknote P in the present exemplary embodiment). As shown in FIG. 3, the projection 22 of the guide plate 20 is formed in a substantially rectangular shape, with the width of the substantially rectangular shape along a direction orthogonal to the conveying direction of the first tape 2 formed as a width that is narrower than the tape width in the direction orthogonal to the conveying direction of the first tape 2.

Explanation follows regarding operation of the above described configuration. In order to store the banknote P, the banknote P is conveyed towards the banknote inlet-outlet 9 of the banknote storage and discharge device 1 by an external conveying path, not shown in the drawings, with the length direction of the banknote P along the conveying direction. The banknote P, as shown in FIG. 1, is inserted between the conveying surfaces 2*a*, 3*a* of the first and second tapes 2, 3 entrained around the first and second deflecting rollers 7*a*, 7*b*.

When the banknote P has been inserted, the clutches 16*a*, 16*b* of the reel shafts 14*a*, 14*b* are switched OFF (a driving force non-transmitting state), and the clutch 16*c* of the drum shaft 15 is switched ON (a driving force transmitting state), driving force of the drive device 11 is transmitted to the drum shaft 15 through the gear train 12, the drum 5 rotates in the anti-clockwise direction as shown in FIG. 1, and the first and second tapes 2, 3 are taken up onto the drum 5 while in a specific tension applied state due to the first and second reels 4*a*, 4*b* that free-wheel under torque limitation by the torque limiters 18*a*, 18*b*.

When this is performed, the inserted banknote P is received between the conveying surfaces 2*a*, 3*a* of the first and second tapes 2, 3, is conveyed with central portions in the short direction sandwiched between the conveying surfaces 2*a*, 3*a* of the first and second tapes 2, 3, and taken up and stored on the drum 5 while still sandwiched between the first and second tapes 2, 3.

In order to discharge the banknote P, the clutches 16*a*, 16*b* of the reel shafts 14*a*, 14*b* are switched ON, and the clutch 16*c* of the drum shaft 15 is switched OFF, and driving force of the drive device 11 is transmitted to the reel shafts 14*a*, 14*b* through the gear train 12 so as to rotate each of the respective reel shafts 14*a*, 14*b* in the anti-clockwise direction as shown in FIG. 1. The first and second tapes 2, 3 are thereby unwound, rotating the drum 5 in the clockwise direction as shown in FIG. 1. The banknote P that has been taken up and stored on the drum 5 is unreeled while still sandwiched between the conveying surfaces 2*a*, 3*a* of the first and second tapes 2, 3, conveyed and discharged from the banknote inlet-outlet 9 by the first and second tapes 2, 3, and passed across to an external conveying path, not shown in the drawings.

When the banknote P is unreeled from the drum 5, the guide plate 20 that is disposed at the tape rear surface 2*b* side of the first tape 2 in the present exemplary embodiment is provided with the projection 22 that is formed with a narrower width than the tape width. Accordingly, even if the unreeling direction leading end sides of the banknote P that has been released from restraint by the drum 5 and the first and second tapes 2, 3 attempts to fold around to cover the tape rear surface 2*b*, a situation shown in FIG. 8, the corner folded portion DE contacts the side face of the projection 22 along the conveying direction, and before the corner folded portion DE covers the tape rear surface 2*b* the fold is pressed out in a direction orthogonal to the conveying direction and corrected. Consequently, the corner folded portion DE is not sandwiched between the first deflecting roller 7*a* and the tape rear surface 2*b* of the first tape 2, and is guided to the opposing face 20*a* of the guide plate 20 facing the first tape 2 by the face 20*b* of the guide plate 20 on the drum 5 side excluding the projection 22, preventing abnormal conveyance of the banknote P being conveyed in the unreeling direction towards the banknote inlet-outlet 9.

In the above description explanation has been given of an example of a case in which the corner folded portion DE is formed to one corner at the unreeling direction leading end side of the banknote P. However, similar applies to cases in which a corner folded portion DE is formed to both corners on the leading end side, and to cases in which a corner folded portion DE is formed to one or both corners on the trailing edge side.

Figure 5:
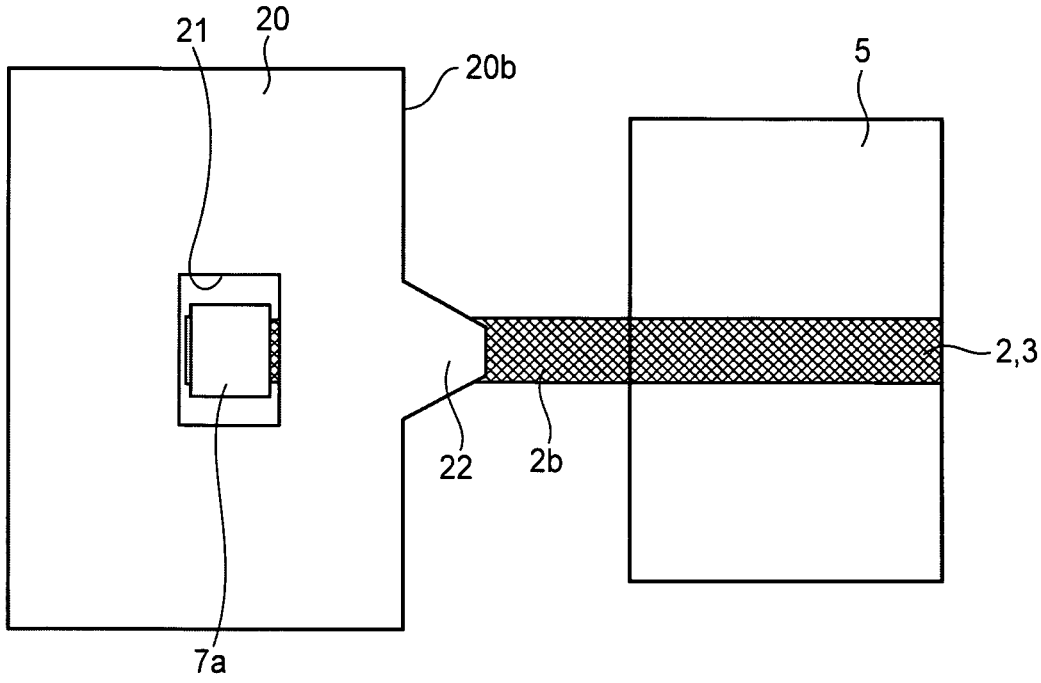
FIG. 5 is an explanatory diagram showing the top face of another embodiment of a guide plate of the first exemplary embodiment.

In the present exemplary embodiment explanation has been given of a case in which the projection 22 is substantially rectangular in shape. However, as shown in FIG. 5, a substantially isosceles trapezoidal shaped projection 22 may be provided at a central portion of the face 20*b* on the drum 5 side of the guide plate 20, formed such that the trapezoid short base side at the leading end of the central portion, this being on the drum 5 side, is narrower than the tape width of the first tape 2, and the trapezoid long base side is wider than the tape width. By so doing, a corner folded portion DE is made to contact a face on a sloping side of the projection 22, this being one of the side faces along the conveying direction, and before to the corner folded portion DE folds around to cover the tape rear surface 2*b*, the fold is gradually pressed out wider in a direction orthogonal to the conveying direction and the fold is gradually straightened out, the corner folded portion DE can be conveyed towards the banknote inlet-outlet 9 while being guided to the opposing face 20*a* of the guide plate 20 by the face 20*b* on the drum 5 side of the guide plate 20 except for the projection 22, and so abnormal conveyance of the banknote P conveyed in the unreeling direction can be prevented.

As explained above, the paper and paper-like sheet storage and discharge device of the present exemplary embodiment includes: the first and second reel on which the first and second tapes are taken up; the drum on which the first and second tapes are taken up with a banknote P still sandwiched between their respective conveying surfaces; the first and second deflecting rollers disposed facing the banknote inlet-outlet and deflecting the first and second tapes towards the drum, respectively; and the guide plate having a projection that projects out towards the drum and is disposed on the first deflecting roller side between the first deflecting roller and the drum at the tape rear surface side of the first tape running from the first deflecting roller to the drum. The first and second tapes, entrained between the first and second reel and the drum via the first and second deflecting rollers, are taken up or unwound, thereby storing or discharging the banknote P. By providing the guide plate, when unreeling of the banknote P from the drum, a corner folded portion DE attempting to fold around and cover the tape rear surface, is made to contact with the side face of the projection along the conveying direction and the fold can be straightened before to the corner folded portion DE covers the tape rear surface, and abnormal conveyance can be prevented of the banknote P being conveyed in the unreeling direction.

Second Exemplary Embodiment

Figure 6:
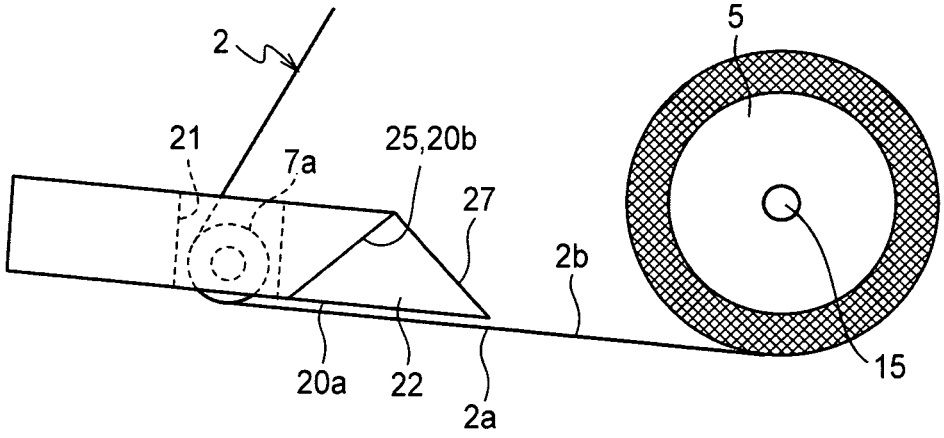
FIG. 6 is an explanatory diagram showing a side face of a guide plate of a second exemplary embodiment.

FIG. 6 is an explanatory diagram showing a side face of a guide plate of a second exemplary embodiment.

Note that portions similar to those of the first exemplary embodiment described above are allocated the same reference numerals and explanation thereof is omitted.

The guide plate 20, serving as a guide of the present exemplary embodiment, is formed as a thick plate from a metallic material or a resin material, and is disposed in a similar position to that in the above first exemplary embodiment. A face 20*b* on the drum 5 side of the guide plate 20, excluding the projection 22, is formed so as to slope as a guide face 25 from the angle between the face 20*b* and the opposing face 20*a*, namely from the angle at the tape rear surface 2*b* side of the first tape 2, so as to approach the drum 5. A sloping face 27 is provided at the leading end portion of the projection 22 on the drum 5 side, sloping from the opposing face 20*a* that faces the tape rear surface 2*b* of the first tape 2 in a direction to separate from the drum 5, namely slopes in the opposite direction to the guide face 25.

The guide plate 20 formed as such a thick plate is particularly applicable to a guide plate 20 molded from a resin material.

The shape of the top face of the projection 22 of the present exemplary embodiment (shape viewed from above) is a substantially rectangular shape, similar to the above first exemplary embodiment.

Figure 8:
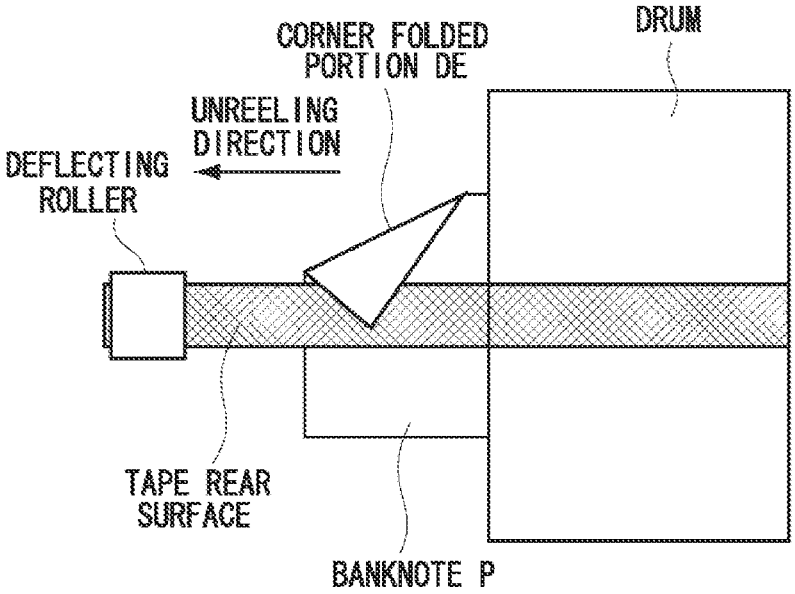
FIG.8 PRIOR ART
FIG. 8 is an explanatory diagram showing a conventional state of a corner folded portion when unreeling a banknote.

As shown in FIG. 8, if the banknote P released from restraint by the drum 5 and the first and second tapes 2, 3 attempts to fold around so as to cover the tape rear surface 2*b*, the corner folded portion DE is made to contact the side face along the conveying direction of the projection 22 that has been formed with a width that is narrower than the tape width. Consequently, before the corner folded portion DE covers the tape rear surface 2*b*, the corner folded portion DE, while being pressed out in a direction orthogonal to the conveying direction and straightened out, is guided to the opposing face 20*a* of the guide plate 20 by the guide face 25 formed as the face 20*b* on the drum 5 side of the guide plate 20, excluding the projection 22, and can be conveyed towards the banknote inlet-outlet 9. Consequently, abnormal conveyance can be prevented of the banknote P being conveyed in the unreeling direction.

Furthermore, since the sloping face 27 on the drum 5 side of the projection 22 slopes in the direction to separate from the drum 5, even if a corner folded portion DE is formed with a strong tendency to fold or curl, the fold of the banknote P can be gradually straightened out while lifting up the corner portion of such a corner folded portion DE.

Note that in the present exemplary embodiment, explanation has been given of a case in which the shape of the projection 22 viewed from above is substantially rectangular.

However, similar effect to that of the above first exemplary embodiment can be obtained with a substantially isosceles trapezoidal shape shown in FIG. 5.

Figure 7:
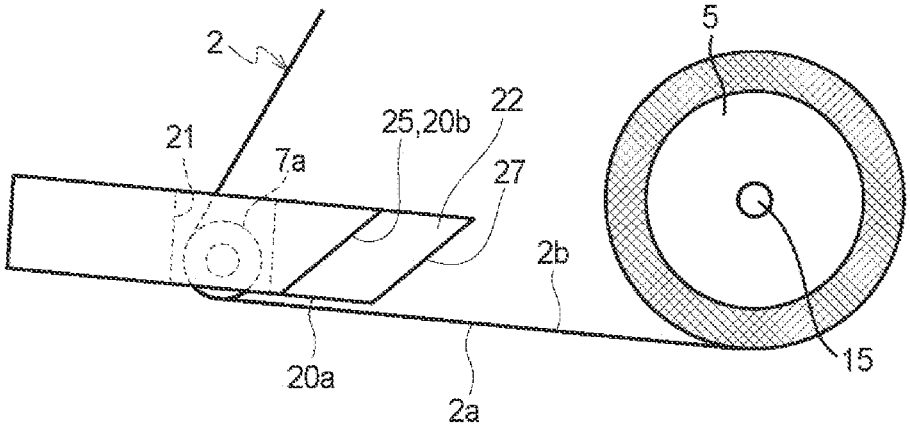
FIG. 7 is an explanatory diagram showing a side face of another embodiment of a guide plate of the second exemplary embodiment.

In the present exemplary embodiment, explanation has been given of a sloping face 27 on the drum 5 side of the projection 22 sloping in the direction to separate from the drum 5. However, as shown in FIG. 7, the sloping face 27 may be formed so as to slope in the direction from the opposing face 20*a* facing the tape rear surface 2*b* of the first tape 2 so as to approach the drum 5, namely formed so as to slope in a similar direction to that of the guide face 25. A similar effect to that of the above first exemplary embodiment can be obtained in this manner too.

As explained above, in the present exemplary embodiment, when the guide plate is formed as a thick plate, a similar effect to that of the first exemplary embodiment can be obtained by providing a sloping face at the leading end portion of the projection. Furthermore, the sloping face is sloped in the direction to separate from the drum. Due thereto, even if there is a corner folded portion DE formed with a strong tendency to fold or curl, the fold of the banknote P can be gradually straightened out while lifting the corner portion of such a corner folded portion DE.

Note that in each of the above exemplary embodiments, explanation has been given of cases in which the shape of the projection viewed from above is a substantially rectangular shape or a substantially isosceles trapezoidal shape. However, configuration may be made as an isosceles triangle with a base side formed wider than the tape width.

Furthermore, in each of the above exemplary embodiments, explanation has been given of tapes formed from a resin material, such as a synthetic rubber of the like. However, there is no limitation of the material for the tape to the above, and configuration may be made with a belt material, such as employed for a conveying belt or the like, or paper or the like.

Furthermore, in each of the above exemplary embodiments, explanation has been given of the guide plate 20 provided only at the tape rear surface 2*b* side of the first tape 2. However, configuration may be made with the guide plate 20 as described above as a first guide plate, and with a second guide plate formed similarly to the first guide plate disposed on the tape rear surface 3*b* side of the first tape 2, facing the first guide plate with the first and second tapes 2, 3 sandwiched in between the two guide plates.

By so doing, even if a corner folded portion DE occurs that attempts to fold around to cover the tape rear surface 3*b* of the second tape 3, abnormal conveyance of the banknote P being conveyed in the unreeling direction can be prevented in a similar manner to described above.

Furthermore, in each of the above exemplary embodiments, explanation has been given of examples of a banknote storage and discharge device in which storage or discharge of banknote P is performed by winding two tapes onto a drum. However, a similar effect can be obtained by applying the guide plate of the present invention to a banknote storage and discharge device in which storage and discharge of banknote P is performed by winding a single tape onto a drum.

In such cases, the guide plate may be disposed on the tape rear surface side of the tape, on the conveying surface side of the tape, or on both of these.

Furthermore, in each of the exemplary embodiments described above, explanation has been given of banknotes as paper/paper-like sheets. However, paper/paper-like sheets are not limited to the above, and checks, deeds, and the like may be employed.

Furthermore, in each of the above exemplary embodiments, explanation has been given of cases in which the guide plate of the present invention is applied to a temporary holding section of an automated transaction device. However, a similar effect can be obtained by application to a conveying path having not guiding of the side edge portions along the conveying direction of the paper/paper-like sheet, on a conveying path for conveying paper/paper-like sheets.

The invention claimed is:

1. A sheet storage and discharge device, comprising:

a reel on which a tape is taken up;

a drum for taking up the tape together with a sheet;

a deflection roller disposed between the reel and the drum and deflecting the tape towards the drum; and a guide that has a face on a drum side thereof, the face being sloped at an angle to a tape movement direction, a portion of the face of the guide being wider than a width of the deflection roller, and the guide having a projection at the face, the projection projecting out towards the drum, the guide disposed at a deflection roller side between the deflection roller and along the tape extending from the deflection roller to the drum, wherein the tape entrained between the reel and the drum via the deflection roller is taken up or unwound, storing or discharging the sheet;

wherein a portion of the projection that extends alongside the surface of the tape includes a portion having a width that is narrower than a width of the tape; and wherein the projection is formed in a substantially trapezoidal shape with a shorter base side on the drum side that is narrower than the width of the tape and a longer base side that is wider than the width of the tape.

2. The sheet storage and discharge device of claim 1, wherein the guide is formed by a plate provided with a sloping face at the drum side of the projection, the sloping face sloping from a face on a tape side of the projection in a direction separating from the drum.

3. The sheet storage and discharge device of claim 1, wherein the guide is formed as a plate provided with a sloping face at the drum side of the projection, the sloping face sloping from a face on a tape side of the projection in a direction approaching the drum.

4. The sheet storage and discharge device of claim 1, wherein the guide extends beyond the deflection roller to the side of the deflection roller opposite to the side at which the drum is disposed.

5. The sheet storage and discharge device of claim 4, wherein the guide has a window portion through which the tape is inserted.

* * * * *